US007909047B2

(12) United States Patent
Kooijker et al.

(10) Patent No.: US 7,909,047 B2
(45) Date of Patent: Mar. 22, 2011

(54) APPARATUS AND METHOD FOR CLEANING AN ELECTRIC HAIR-CUTTING DEVICE, AND KIT INCLUDING SUCH AN APPARATUS

(75) Inventors: Klaas Kooijker, Drachtehn (NL); Fokke Roelof Voorhorst, Drachten (NL); Martijn Van Baren, Drachten (NL); Jacob Brinkert, Drachten (NL); Alastair Ian Blake, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 380 days.

(21) Appl. No.: 12/064,042

(22) PCT Filed: Aug. 16, 2006

(86) PCT No.: PCT/IB2006/052803

§ 371 (c)(1), (2), (4) Date: Feb. 18, 2008

(87) PCT Pub. No.: WO2007/020590

PCT Pub. Date: Feb. 22, 2007

(65) Prior Publication Data

US 2008/0216874 A1 Sep. 11, 2008

(30) Foreign Application Priority Data

Aug. 17, 2005 (EP) ..... 05107540

(51) Int. Cl.
*B08B 3/00* (2006.01)

(52) U.S. Cl. ..... 134/111; 134/34; 134/184; 134/189; 134/190; 134/195

(58) Field of Classification Search ..... 134/111, 134/34, 184, 189, 190, 195
See application file for complete search history.

(56) References Cited

U.S. PATENT DOCUMENTS

| | | | | |
|---|---|---|---|---|
| 3,172,416 | A * | 3/1965 | Simmons | 134/111 |
| 3,634,935 | A * | 1/1972 | Battigalli | 30/41.5 |
| 6,065,860 | A * | 5/2000 | Fuchsbichler | 366/136 |
| 6,125,826 | A | 10/2000 | Brocard | |
| 2004/0154650 | A1 * | 8/2004 | Saito et al. | 134/56 R |
| 2004/0194326 | A1 * | 10/2004 | Kappes et al. | 30/537 |
| 2006/0048802 | A1 * | 3/2006 | Kappes et al. | 134/184 |
| 2006/0107971 | A1 * | 5/2006 | Chasen et al. | 134/10 |

FOREIGN PATENT DOCUMENTS

| | | | |
|---|---|---|---|
| EP | 0664973 | A1 | 8/1995 |
| JP | 06178876 | A * | 6/1994 |
| WO | 2004062420 | | 4/2004 |
| WO | 2004064569 | | 8/2004 |

OTHER PUBLICATIONS

JP 06-178876 Abstract.*
JP 06-178876 Machine Translation.*
JP 06-178876 English translation.*

* cited by examiner

*Primary Examiner* — Michael Barr
*Assistant Examiner* — Charles W Kling
(74) *Attorney, Agent, or Firm* — Sherry Womack

(57) ABSTRACT

A cleaning apparatus (4) for cleaning a hair-cutting portion (2) of an electric hair-cutting device (1) includes a cleaning-liquid basin (5) for receiving the hair-cutting portion of the electric hair-cutting device in a central area such that the hair-cutting portion is at least partially immersed in the cleaning liquid (13). The electric hair-cutting device is cleaned by generating a cleaning-liquid flow revolving within the basin (5) around the central area of the basin, the hair-cutting portion being at least partially immersed in the cleaning liquid. The liquid flow effectively entrains debris away from the hair-cutting portion.

10 Claims, 2 Drawing Sheets

APPARATUS AND METHOD FOR CLEANING AN ELECTRIC HAIR-CUTTING DEVICE, AND KIT INCLUDING SUCH AN APPARATUS

The invention relates to a method of cleaning a hair-cutting portion of an electric hair-cutting device, to an apparatus for use in such a method, and to a kit comprising such an apparatus and an electric hair-cutting device.

Electric hair-cutting devices, such as shavers and trimmers, generally have a housing containing a motor, which housing is designed such that the electric shaver may be hand-held during use. At a hair-cutting portion, usually an end portion of the hair cutting device in the form of a shaving head, one or more cutters are arranged, for instance in the form of one or more shaving heads or in the form of hair-trimming cutters.

In practice, two main types of electric shavers are most widespread: foil shavers and rotary shavers. Foil shavers have an external cutter in the form of a thin, flexible mesh screen foil behind which a cutter is reciprocally movable. Rotary shavers have one or more shaving heads, each having a circular stationary external cutter blade behind which a number of circumferentially distributed movable cutters are rotatably movable about an axis coaxial with the center of the external cutter blade. In operation, hairs protruding through apertures in the external cutter are cut by cooperation of the external cutter and the internal cutter moving along the external cutter.

From EP 0 664 973, a cleaning apparatus is known that includes a holder for holding an electric shaver with its shaving head facing downward in a cleaning basin. During cleaning, a pump continuously pumps cleaning liquid out of a reservoir into the cleaning basin. Via an outlet port at the bottom of the basin, a return flow of cleaning liquid flows back to the reservoir. Debris from the shaver is entrained by the cleaning liquid flowing back to the reservoir. The cleaning fluid is filtered before it is re-introduced into the basin.

A disadvantage of such a cleaning apparatus is that the debris is not removed effectively and substantial amounts of debris tend to stick to the apparatus. Debris-containing cleaning fluid particularly leaves hair debris on parts of the electric shaver after draining off the liquid or after lifting the immersed portion of the shaver out of the cleaning liquid and also on parts where liquid spatters have landed on the shaver.

It is an object of the invention to provide a cleaning apparatus and a method of more effectively cleaning a hair-cutting portion of an electric hair-cutting device.

According to the present invention, this object is achieved by providing a cleaning apparatus including a liquid-flow generator for generating a cleaning-liquid flow revolving tangentially around an axis formed between the top and bottom portions within the basin. The invention may also be embodied in a kit. Furthermore, the invention may be embodied in a method for generating a cleaning-liquid flow revolving tangentially around an axis formed between the top and bottom portions within the basin.

The cleaning-liquid flow revolving within the cleaning basin around the central receiving area effectively entrains hair debris away from the hair-cutting portion of the hair-cutting device. In particular, relatively high liquid flow velocities closely along the hair-cutting portion can be achieved without requiring a high rate of circulation of the flow into and out of the basin.

Particular embodiments of the invention are set forth in the dependent claims.

Further aspects, effects and details of the invention are set forth in the detailed description with reference to embodiments of the invention, of which some are shown in the drawings. In the drawings.

Figure 2:
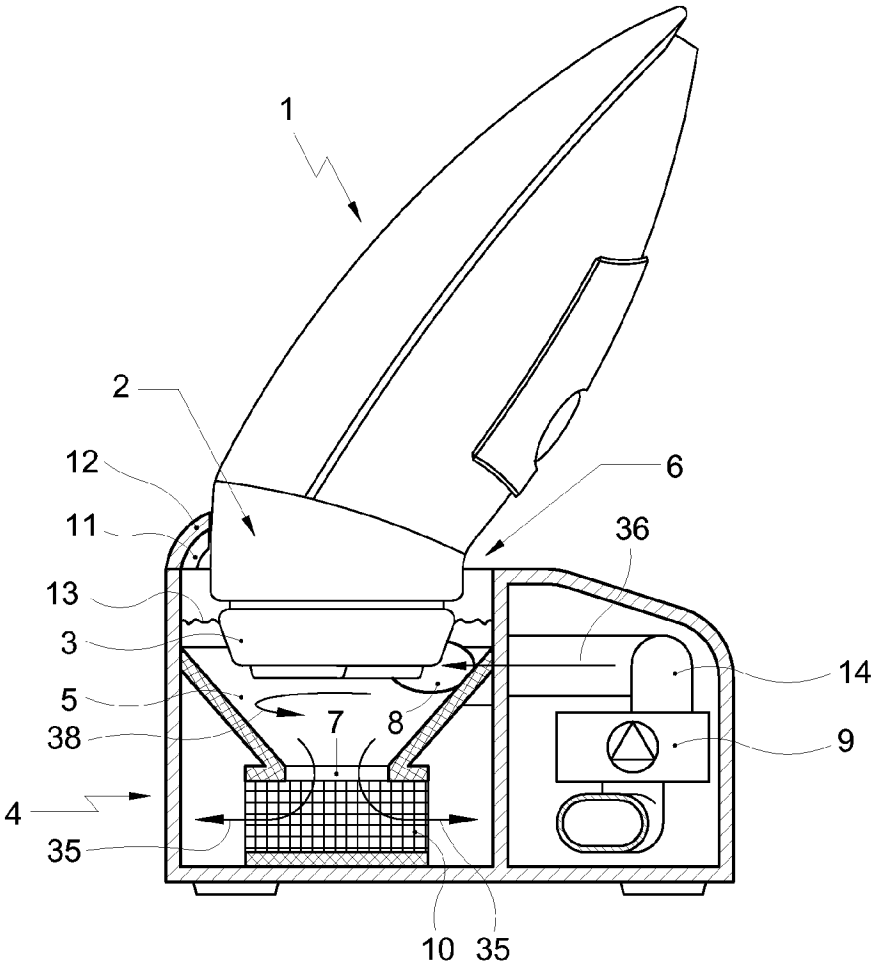
FIG. 2 is a schematic cut-away side view of the cleaning apparatus of FIG. 1.
Figure 1:
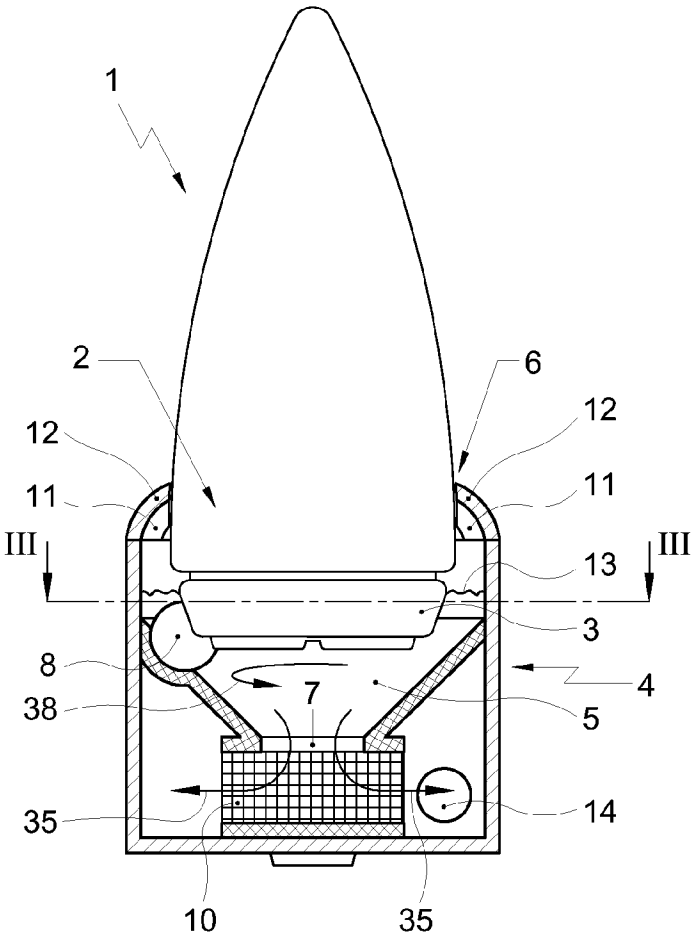
FIG. 1 is a schematic cut-away frontal view of an embodiment of a cleaning apparatus according to the invention and a hair-cutting device.
Figure 3:
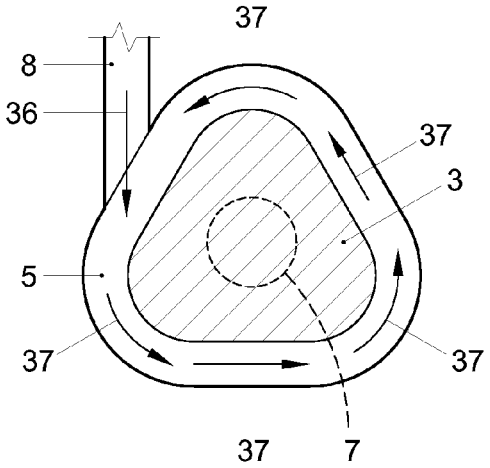
FIG. 3 is a schematic view in cross-section along the line III-III in FIG. 1.

The embodiment of a cleaning apparatus 4 according to the invention shown in FIGS. 1 to 3 is specifically suitable for removing hair-cutting debris from a hair-cutting portion 2 of an electric shaver 1 of the type shown in the drawings. Cleaning apparatuses according to the invention for cleaning other types of shavers or other hair-cutting devices or of a more general-purpose design may have accordingly adapted shapes.

A basin 5 of the cleaning apparatus 4 is used for holding a cleaning liquid 13 and is accessible for a shaver 1 to be cleaned via a receiving opening 6 that can receive the hair-cutting portion 2 of the electric shaver 1 in a central receiving area of the basin 5, where the hair-cutting portion 2 of the electric shaver 1 may be partially immersed in the cleaning liquid 13 when the cleaning apparatus is in operative condition.

A pump 9 is arranged in a liquid-circulation circuit 14 for generating a cleaning-liquid flow and is situated downstream of a cleaning-liquid outlet port 7, for letting liquid out of the basin 5 (arrows 35), and upstream of a cleaning-liquid inlet port 8, for letting liquid into the basin 5 (arrow 36). The pump 9 and the liquid-circulation circuit 14 form a liquid-flow generator for generating not only a liquid-circulation flow circulating through the basin and the circuit, but also a liquid flow (arrows 37, 38) revolving within the basin 5 around and under the central receiving area. In operation, the liquid flow revolving within the basin 5 effectively entrains hair debris away from the hair-cutting portion 2 of the electrical shaver 1. As relatively high flow velocities can thus be achieved along the hair-cutting portion 2 (more specifically, in this example, along the shaving head holder 3) of the shaver 1, tendencies of hair debris to cling to the hair-cutting portion 2 or to stay in close vicinity of the hair-cutting portion 2 and subsequently stick to the hair-cutting portion 2 or to the shaver when the shaver is taken out of the liquid or the liquid is drained from the basin are particularly effectively counteracted. The revolving flow forms a (somewhat deformed) vortex spiraling about an axis of rotation to the outlet 7. The flow has an axial flow component so that the flow follows an essentially helical path.

In operation, the cleaning liquid 13 is pumped into the basin 5 via the cleaning-liquid inlet port 8. The inlet port 8 is oriented tangentially to the perimeter of the basin 5 so that the liquid 13 enters the basin 5 in a tangential direction close to the circumferential wall of the basin 5 and a circulation of the cleaning liquid, not only through, but also within the basin 5 is caused.

The cleaning-liquid inlet port 8 opens into an upper portion of the basin 5. Thus, the liquid flow revolving within the basin 5 is driven in the upper portion of the basin 5 in which the hair-cutting portion 2 is immersed Thus, the flow velocities are particularly high in the portion of the basin 5 from which hair debris is to be entrained.

Preferably, the motor of the shaver 1 is on during cleaning, driving the movable internal cutters of the shaving heads. If the shaver is of the rotary type and provided with outflow openings communicating with internal space behind the external cutters, the rotary movement of the internal cutters of the shaver 1 in combination with the angled orientation of the cutting surfaces sloping to the stationary external cutting surface in rotary sense, then causes liquid to be pumped into the shaving heads via the openings in the external cutter and out of the shaving heads via the outlet. It is then particularly advantageous that debris exhausted from the shaving heads is quickly diluted and entrained with the flow passing along the shaving heads at a relatively high velocity.

For a more uniform flow pattern around the immersed portion of the hair-cutting portion of the shaver, two or more, circumferentially distributed, cleaning-liquid inlet ports may be provided in the perimeter of the basin.

For a uniform flow pattern around the immersed portion of the hair-cutting portion of the shaver and for minimizing the volume of cleaning liquid needed, it is advantageous if the basin 5 is shaped so as to leave a clearance of substantially constant width and/or (seen in cross-section perpendicularly to a most adjacent portion of the wall) shape between the sidewalls of the basin and the hair-cutting portion 2 or at least the immersed portion of hair-cutting portion 2 of the electric shaver.

The cleaning-liquid outlet port 7 is situated in a central area of the bottom of the basin 5. In the lower central area of the basin 5, the cleaning-liquid velocity is minimal, which is favorable for sedimentation of the debris. Extracting the cleaning liquid from that area of the basin is advantageous for entraining a relatively large proportion of the debris out of the basin.

A filter 10 for filtering hair-cutting debris out of the cleaning liquid is located in the circuit, downstream of the cleaning-liquid outlet port 7, and extends around a filter space. This allows to provide a relatively large filter surface in a relatively compact arrangement and removal of the filtered hair debris is facilitated, because the hair debris is collected inside the filter 10 so that it can easily be removed from the apparatus by removing the filter 10. The filter may for instance be cylindrical or triangular when seen in plan view. In operation, the liquid flows axially into the filter body 10 and radially out of the filter 10 (arrows 35).

For instance, an electric shaver to be cleaned can be placed with its hair-cutting portion in between the supports 12. The supports 12 support the electric shaver 1 at the location where the housing becomes wider than the opening bounded by the supports 12, and support the electric shaver 1, together with its hair-cutting portion 2 in a cleaning position, with the shaving head 3 and a portion of the hair-cutting portion 2 being immersed in the cleaning fluid. With the electric shaver 1 in a stable position, the hair-cutting portion 2 of the electric shaver 1 can be cleaned.

Depending on the degree of soiling, the pump can be run for a certain duration. Also a combination of a pump and a timer is possible. Alternatively, or additionally, the flow rate generated by the pump may be adjustable, for instance by controlling the power fed to the pump.

After the cleaning process, the electric shaver 1 can be taken out to dry, and is ready for use.

However, an embodiment according to the invention can also be integrated in a cleaning system that also provides, for example, the possibility of storing, loading, or any other kind of function needed for the use of an electric shaver 1.

Figure 4:
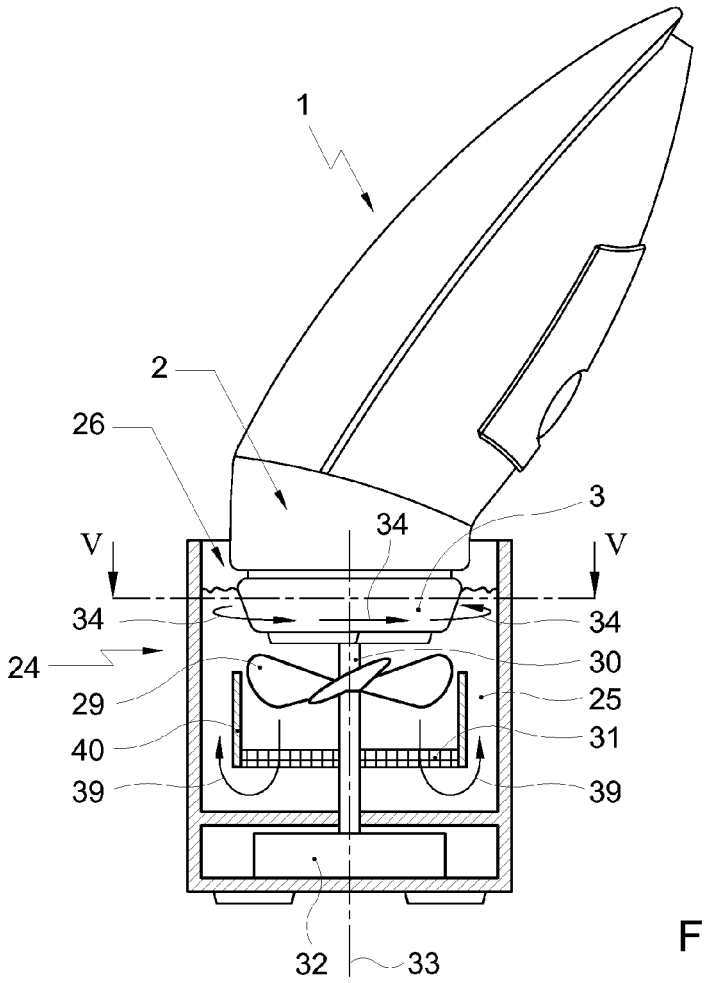
FIG. 4 is a cut-away frontal view of a further embodiment of a cleaning apparatus according to the invention and a hair-cutting device.
Figure 5:
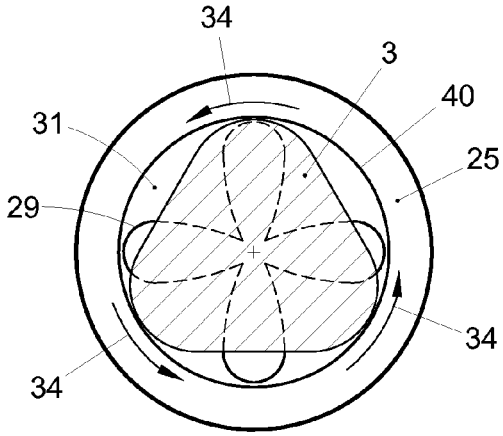
FIG. 5 is a schematic view in cross-section along the line V-V in FIG. 4.

It will be clear to the skilled person that within the framework of the invention, as set forth in the claims, many variations other than the examples described above are conceivable. For instance, a cleaning apparatus 24, as is shown in FIGS. 4 and 5. In this embodiment, the apparatus is not equipped with a support for receiving and retaining the electric shaver 1 in the cleaning position. The user has to hold the electric shaver 1 in the cleaning-liquid basin 5 by hand during cleaning. The depth of immersion of the shaver 1 is limited by a central support member 30, which also prevents the shaver 1 from contacting a propeller 29 in the basin 25.

The propeller 29 in the basin is arranged above an area bounded by a sleeve 40. In the sleeve 40, a filter 31 is suspended. In operation, the propeller drives a flow (arrows 34) of liquid in the basin 25 about an axis 33 and is suspended for rotation about the axis 33 that also forms a vertical axis of the basin 25. The propeller 29 also drives a liquid flow downwards through the sleeve 40 and through the filter 31, after which the liquid flow returns through a space between the sleeve and the sidewall of the basin (arrows 39). For driving the rotation of the propeller 29, the propeller 29 is coupled to a motor 32. Preferably, a switch is provided that switches on the motor 32 in response to the presence of the shaver 1 in the shaving position. The switch may, for instance, be operated via the support member 30, causing the cleaning liquid to start revolving in response to a shaver 1 being held in a cleaning position.

Since, in operation, the liquid flows through the filter 31, debris is filtered out of the cleaning liquid circulating within the cleaning basin. The revolving flow forms a vortex revolving about an axis of rotation. In an upper portion of the basin 25, the vortex is without a substantial flow component in a direction parallel to the axis of rotation, while in a lower portion of the basin, the flow is directed mainly downwards and upwards. To restrict rotation of the liquid inside the sleeve, mainly axially oriented guide baffles may be provided inside the sleeve 40.

For enhancing the rate at which the fluid flow revolves within the basin, and in particular in a portion of the basin under the hair-cutting portion of the shaver, where the propeller 29 and the filter screens 31 rotate, it is advantageous if, seen in plan view, the basin 25 has a circular perimeter. The basin 25 then evenly guides the cleaning liquid along the sides of the basin 25, as indicated by the arrows 34.

The invention claimed is:

1. A cleaning apparatus for cleaning a hair-cutting portion of an electric hair-cutting device, said apparatus comprising:

a cleaning-liquid basin for holding a cleaning liquid when the cleaning apparatus is in an operative condition, the basin comprising an opening in an upper potion of the basin for receiving the hair-cutting portion of the electric hair-cutting device in a central receiving area when the cleaning apparatus is in the operative condition, such that the hair-cutting portion is at least partially immersed in the cleaning liquid, at least one cleaning-liquid inlet port in the upper portion, for liquid flow into the basin and a cleaning-liquid outlet port positioned centrally and in a bottom portion of the basin; and a liquid-flow generator for generating a cleaning-liquid flow revolving tangentially around an axis formed between the top and bottom portions within the basin around said central receiving area and having an axial flow component so that the cleaning-liquid flow follows an essentially helical path from the at least one cleaning-liquid inlet port to the cleaning-liquid outlet port when the cleaning apparatus is in the operative condition.

2. The apparatus according to claim 1, wherein said liquid-flow generator is suitable and arranged for generating said revolving cleaning-liquid flow in at least the upper portion of the basin.

3. The apparatus according to claim 1, wherein the liquid flow generator comprises a pump for pumping the liquid from the at least one cleaning-liquid outlet port to the at least one cleaning-liquid inlet port, wherein the at least one cleaning-liquid inlet port is directed tangentially relative to the perimeter of the basin, such that the liquid enters the basin in a tangential direction closely along a circumferential wall of the basin.

4. The apparatus according to claim 3, wherein the basin has a bottom having a central area, wherein the cleaning-liquid outlet port is situated in said central area.

5. The apparatus according to claim 1, further comprising a support for supporting the hair-cutting portion of the electric hair-cutting device in a cleaning position.

6. The apparatus according to claim 1, wherein, in plan view, the basin has a triangular perimeter.

7. A kit comprising a cleaning apparatus according to claim 1 and an electric hair-cutting device having a hair-cutting portion, wherein, when the hair-cutting portion of the hair-cutting device is received in the basin for at least partial immersion in the liquid when the cleaning apparatus is in the operative condition, a clearance of substantially constant width is left between sidewalls of the basin and the hair-cutting portion or at least the immersed portion of the hair-cutting portion.

8. A method of cleaning a hair-cutting portion of an electric hair-cutting device, comprising:

providing a basin containing a cleaning liquid, the basin having an upper potion, a bottom portion, at least one cleaning-liquid inlet port in the upper portion, for liquid flow into the basin and a cleaning-liquid outlet port positioned centrally and in a bottom portion of the basin when the basin is in an operative condition;

at least partially immersing the hair-cutting portion of the electric hair-cutting device in the cleaning liquid; and generating a cleaning-liquid flow revolving tangentially around an axis formed between the top and bottom portions within the basin around the hair-cutting portion and having an axial flow component so that the cleaning-liquid flow follows an essentially helical path from the at least one cleaning-liquid inlet port to the cleaning-liquid outlet port when the cleaning apparatus is in the operative condition.

9. The method according to claim 8, further comprising pumping the cleaning liquid out of the basin via the outlet port in a central area of a bottom of the basin, and pumping the liquid into the basin in the upper portion of the basin when the cleaning apparatus is in the operative condition.

10. The method according to claim 8, wherein in plan view, the basin has a triangular perimeter and the flow of the cleaning liquid in the basin forms a vortex along the triangular perimeter when the cleaning apparatus is in the operative condition.

* * * * *